US006604946B2

(12) United States Patent
Oakes

(10) Patent No.: US 6,604,946 B2
(45) Date of Patent: Aug. 12, 2003

(54) NON-LETHAL SMALL ARMS PROJECTILE FOR USE WITH A READER-TARGET FOR AMUSEMENT, SPORTS AND TRAINING

(76) Inventor: Mike Glen Oakes, 9715 SW. 130th Ave., Beaverton, OR (US) 97008

( * ) Notice: Subject to any disclaimer, the term of this patent is extended or adjusted under 35 U.S.C. 154(b) by 0 days.

(21) Appl. No.: 09/941,954

(22) Filed: Aug. 29, 2001

(65) Prior Publication Data

US 2003/0060288 A1 Mar. 27, 2003

(51) Int. Cl.[7] ..... F41A 33/00; A63B 65/02; F42B 8/00; F41J 9/00; G06G 7/80

(52) U.S. Cl. ..... 434/11; 273/348; 102/444; 473/570; 473/578; 235/400

(58) Field of Search ..... 463/1, 49–53, 463/56–57; 473/569–570, 578; 434/11, 16, 20–23; 102/430, 444, 498, 529; 340/5.2, 5.8, 10.1, 10.4, 10.42, 323 R, 825, 825.57, 825.72; 235/375, 400; 342/27, 42, 44, 51–52, 58; 273/348, 371, 348.3–348.5, 372, 374

(56) References Cited

U.S. PATENT DOCUMENTS 4,545,583 A * 10/1985 Pearman
5,016,536 A * 5/1991 Brighton
5,024,447 A * 6/1991 Jude

* cited by examiner

*Primary Examiner*—Mark Sager

(57) ABSTRACT

A non-lethal small arms analogous projectile 10 and reader-target for use in sporting, amusement, or training applications is described, wherein the non-lethal projectile 10 contains encoded information and means for transmitting the encoded information upon coinciding with the reader-target 22. The non-lethal projectile 10 contains a transmitter or transponder 18 which is activated upon coinciding with the reader-target 22, communicating data 42 to a receiver 36 within the reader-target which can then operate hit-indicating means 24, and transfer the data to a computer via contact, or wireless, connection for further analysis and interpretation. The non-lethal projectile 10 can be formed in any of a variety of shapes for use in many diverse applications and can be encased in a resilient, energy-absorbing material to withstand many reuses.

11 Claims, 3 Drawing Sheets

NON-LETHAL SMALL ARMS PROJECTILE FOR USE WITH A READER-TARGET FOR AMUSEMENT, SPORTS AND TRAINING

FIELD OF THE INVENTION

This invention relates to non-lethal projectiles as applied to tactical training and active games, sports or toys. More particularly, the invention describes means for data transmission from a direct-fire, small arms type projectile to a discreet reader-target for hit-indication, scoring, and logistical purposes.

BACKGROUND OF THE INVENTION

Non-lethal direct fire combat simulation projectiles are projectiles designed to be usable upon human targets providing certain safety precautions are observed. Non-lethal combat simulation projectiles first saw use in direct fire applications prior to World War II when Germany began a new training system for their elite troops utilizing special light-weight wooden bullets in combination with reduced powder charges for their standard service weapons. These special bullets were used for exchanging fire with similarly armed opponents to acclimate trainees to battlefield conditions while training basic marksmanship skills.

The training systems developed for similar weapons and ammunition is now called force-on-force training due to its application in combat training where trainees are introduced to battlefield stress induced by the threat of incoming non-lethal projectiles fired by aggressor forces. After the war, force-on-force training utilizing actual projectiles waned and was not restarted on a large scale until the last few years. Instead, due to the advances in radiant (light, infra-red, or laser) technology, most new research money was allocated toward developing lasers for tactical training. Initially, lasers seemed to promise hi tech solutions to most tactical-training problems but as the years passed, despite widespread adoption of laser-type training weapons, the limitations of laser technology began to grow increasingly evident. On Dec. 16, 1986, a patent, (U.S. Pat. No. 4,629,427) was issued to Gallagher and assigned to Loral Electro-Optical Systems, Inc. that deals with some more highly technical solutions to problems associated with laser training systems and further mentioned problems that are not entirely solved such as a "near-field pseudo-miss" which is still a problem with laser training. Each shortcoming in laser-based technology has been attacked through enormous effort and expense but the conclusion has become evident to all but the most ardent supporters.

Lasers and other radiant projectile simulators cannot closely mimic the performance of projectiles due to their insubstantial nature. Laser representations of projectiles do not induce fear, anxiety, or an adrenaline reaction in trainees so the ability to duplicate any combat conditions is nearly impossible. Near misses by the invisible lasers are not observable by trainees thus evasive actions to avoid further enemy fire is not practiced.

Lasers, by virtue of their physical nature, are not effected by the earth's gravity in the way that bullets are and thus do not in any way simulate the ballistic nature of all standard projectiles. Gallagher's Patent mentioned above states in its first claim " . . . (a) laser beam simulating the trajectory of a projectile comprising: . . . " The definition of the word "trajectory" indicates a curve in the vertical plane traced by an object moving through space. Lasers do not curve under normal earth conditions and cannot "simulate the trajectory" of a projectile. Only a non-lethal projectile can simulate the trajectory of a lethal projectile for training purposes.

Further, laser-beams utilized in training equipment expand in diameter as they progress in range from their source, thus a beam measuring one inch outside diameter at its point of origin, may expand to 12 inches in outside diameter at a range of one-hundred yards, whereas, normal bullets maintain a constant diameter from the muzzle to the bullet's maximum range. This expanding tendency in laser or light beams allows trainees to aim less precisely as the range increases and still hit their target which is completely opposite the principles of firearms marksmanship where a distant target is much more difficult to hit than a nearby target.

Utilizing the same radiant or laser-based technology some more recent inventions have based the laser or light emitting technology in various devices analogous to area effect explosives such as hand-grenades, artillery shells and mines (U.S. Pat. No. 5,481,979 Herbert Walder and, U.S. Pat. No. 5,246,372 Carl J. Campagnuolo). These area effect weapon simulators utilize light-emitting diodes, lasers, or other sources to communicate to target sensors as a simulated explosion when activated. These devices may be utilized in conjunction with the technology mentioned above from Loral Electro-Optical Systems and can only fill the role of area effect weapons simulators because they cannot discreetly address a single target nor are they designed to be utilized in a direct fire format such as in a rifle or pistol bullet analogy, due to size, impact activation, and mechanical requirements. By definition, area effect weapons have a "blast radius" or "kill radius" for attacking multiple targets within a specified area. This blast radius is simulated with Walder's invention and Campagnuolo's invention by an indiscriminate, multi-directional radiation of infra-red or laser energy. Because they indiscriminately radiate their signal in all directions they cannot discreetly address one target while another equidistant target is present without counting hits upon both targets, therefore they are not usable for small-arms, direct fire applications. Also, like all laser or light emitting technologies these devices will not signal hits upon a trainee sensor shielded even by a sheet of paper, clothing or leaves.

These and other failures, intrinsic to laser technology have prompted recent manufacturers to produce or adapt a small number of products to represent small arms, direct-fire projectiles for use in tactical training. These products include the use of a dye-filled hard-gelatin capsule, called a "paintball" (U.S. Pat. No. 5,001,880 Henry J. Smith) because of the nominal sphere-shape generally adopted by the manufacturers; and a few wax or gelatin bullets (U.S. Pat. No. 5,016,536 Richard W. Brighton) also utilizing a marking or dye-type solution, all of which are frangible, or are designed to break or disintegrate and mark opponents. Although these analog marking projectiles have in many cases done much to improve the small arms, live fire aspects of tactical training, they have not been widely accepted due to a variety of weaknesses.

One of the chief problems with frangible marking projectiles is the structural weakness integral to most of the offered projectiles; they must be of sufficient structural strength to withstand the pressures and friction of being fired out of a weapon and yet must be fragile enough to break or disintegrate upon impact on a trainee or a target. To add to the complexity of the structural frailty it must be understood that training may take place under widely varying atmospheric conditions ranging from very cold and wet, to extremely hot and arid all of which will generally effect the resilience or brittleness of these frangible projectiles either causing them to break or disintegrate within the barrel, or bounce upon contact with a target. Due to these structural short-comings, the non-lethal frangible training projectile will often strike a trainee in such a way that it fails to disintegrate and mark the trainee or, should it disintegrate upon bare skin, sharp gelatin fragments are often driven into the skin causing the skin to bleed. Also, these projectiles frequently strike a trainee in such a way (on a piece of equipment perhaps) that he or she is unable to detect the impact and thus continues to aggress or take part in an exercise when he or she should be eliminated.

Yet another problem is the inability to regulate, administer or grade a training exercise. For instance: trainees may be eliminated by dye-marks upon them from "friendly-fire" (shots from a fellow trainee on the same team), or marks from a previous training session, or even near-misses that sprayed dye-material onto the trainee, without the ability of differentiating between these. Furthermore, even careful observation of the trainees will have only limited success in determining which participants are actively and effectively engaging the simulated enemy, as these projectiles are not individually identifiable, are difficult to see in flight especially when many are in flight at one time, and the participants, by the very nature of combat will be doing their utmost to remain concealed from sight.

A field related to tactical training which also relates to this present invention is called "combat simulation games" or "action pursuit games" mentioned in U.S. Pat. No. 4,695,058 George A. Carter; in U.S. Pat. No. 5,001,880 Henry J. Smith, in U.S. Pat. No. 5,221,092 William F. Simons, and U.S. Pat. No. 5,354,057 Ralph T. Pruitt, and others. These games, based on fantastic simulations of combat amongst a plurality of players for entertainment purposes, are a commercial reality at this time. These games can be set in a modern, archaic, or futuristic setting and utilize projectile technology such as paintballs (U.S. Pat. No. 5,001,880) or radiant technology such as lasers (U.S. Pat. No. 4,695,058 and U.S. Pat. No. 4,545,583) or, in the case of Pruitt's patent, a staggering array of video cameras and impact-sensitive costumes, to simulate the effects and represent the weapons-medium of armed, person-against-person conflict.

Like the field of tactical training, combat simulation games have included the use of both analog physical projectiles and radiant simulators, and like tactical training, much greater effort and expense has been applied to the use of lasers and other radiant technology than has been exerted in regard to actual projectiles as evidenced by the wealth and diversity of patents concerning radiant-type weapon simulators.

The labor-intensive system proposed within Ralph T. Pruitt's patent fits neither into the strict radiant category nor into the marking-projectile field due to its complex array of technology, and reliance on melee-style weapons such as swords and spears. Requiring constant video surveillance of all opponents at all times during simulated combat, Pruitt's system cannot differentiate between a hit from a player's own weapon upon himself, nor the hit of a fellow teammate, and cannot give credit or score to individual players based on hit-indicating hardware. This is caused by the analog nature of the information presented by the weapon to the target and the inability to differentiate one weapon from another through unique signals generated by the weapons. Using a piezo-electric element to produce a charge upon impact and an elongated resistor to detect the charge voltage provides only an "on or off" signal similar to a light-switch and cannot transmit data for scoring needs. Further, Pruitt's system requires "pressure-sensitive" elements which may not activate reliably on all actual hits, and due to the fixed, analog nature of the hit indication, players may strike and eliminate other players after they themselves have been struck and eliminated. Rather than offering an independent electronic system, Pruitt's system offers constant human observation and supervision to correct the many shortcomings presented by such a base, analog system.

At this time the paintball-type projectile is widely sold and used in combat simulation games and is felt by players to offer great thrills through tactile involvement with the paintball projectiles such as hearing, seeing and feeling actual projectiles as the projectiles strike nearby objects, fly by players, or strike players.

There are many problems with the paintball technology for use in sports and games in addition to problems mentioned in conjunction to military training. One serious problem is caused by the dye-fill of paintballs and other marking devices involving clean-up of game facilities. These dyes are formulated to be non-toxic and bio-degradable to be safe for human participants, but this also creates a problem in that micro-organisms consume the dye material through the biodegradation process and cause an unpleasant odor. This does not allow combat simulation games involving dye-marking projectiles to be used in quality indoor facilities without destroying or degrading the facility over time.

Since combat simulation is a game, there is a score kept by players, and very skilled participants take part in tournaments where prizes are awarded to the best player or teams of players. As in all competitions there are persons who intentionally break rules to gain advantages over other players and win the prizes at the above mentioned events. Due to the gross, analog nature of dye-marking pellets there is no way to keep participants from wiping dye-material from their garments upon being shot by an opponent and further, no way to determine if one player shot another player before or after the first player was shot. Like tactical training, players in combat simulation games strive to keep concealed, thus judging or marshaling such events is difficult at best, and cheating players are a constant irritant to participants, and often effect the outcome of expensive tournaments.

Radiant-technology based combat simulation games have little problem with cheating due to improved technological systems but instead have greater difficulty evoking the thrills inspired by near-misses (which are generally imperceptible), by hits (which are only detected through an electronically generated sound) and other thrill-heightening tactile interaction. Evidence of this is present in the high number of laser-based combat simulation game-providers who have consequently ceased to do business and, further, the elimination of laser games in general from trade publications such as Action Pursuit Games Magazine 4201 Van Owen blvd. Burbank, Calif. 91505. Action Pursuit Games Magazine stopped all coverage of the laser games because of complaints about the lack of realism and excitement in laser games (October 1987 issue).

With all of these technologies there has followed simplified versions for use as children's toys which in turn experience the same strengths or weaknesses of their above technological forbears.

It is therefore an object of this invention to provide a medium wherein the above noted problems and failures are overcome by introducing a system that utilizes actual physical projectiles, incorporating means for transmitting data to a target.

Though certain prior art depicts numerous training and target-shooting lasers, and several training and target shooting non-lethal projectiles, as well as artillery and explosive simulators, no prior art known to the applicants describes a non-lethal, small arms direct fire projectile device containing means for communicating data to a target. Further, no known prior art describes a non-lethal direct fire projectile device containing a means for storing data, nor any non-lethal projectile whatsoever capable of transmitting data discreetly to a single target to the exclusion of other nearby targets.

SUMMARY OF THE INVENTION

In one form of the invention the non-lethal projectile and target apparatus for amusement, sport and training is comprised of encoded non-lethal small arms projectiles and reader-targets wherein a projectile in very close proximity to a reader-target, or a certain defined portion of the reader-target, may enter a magnetic field generated by the reader-target, be interrogated by, and respond to the reader-target in an interrogator-responsor inductively coupled transponder system known to those skilled in the electronic arts and described within a number of patents including U.S. Pat. No. 4,630,044. In another form the encoded non-lethal small arms projectile may transmit the coded signal to the reader-target in a tightly focused, extremely close-ranged RF signal from the projectile, powered by a battery, capacitor or other internal power supply. In yet another form of the invention, the projectile may utilize an impact-activated RF pulse in the form of a piezo power-generating device or a similar technology known to those versed in the electronic arts, which would initiate the signal to the target. The goal in all embodiments is to provide a non-lethal small arms projectile which can be safely fired directly onto a human target, which will then transmit a unique signal discreetly to the impacted reader-target upon coinciding with the human target and the reader-target worn by the human target. The information within these signals can vary but could include the identification of the user or shooter of the projectile, what type of ammunition the projectile is meant to simulate (i.e., armor piercing, explosive, frangible or others) and what team the shooter or user of the projectile may belong to.

The non-lethal projectiles could be formed in a variety of shapes including: spherical, cylindrical, elliptical and others; and could be formed in a variety of sizes generally ranging from 0.20 inches in diameter to 1 or more inches in diameter depending on the application, or weapon to be simulated. The non-lethal projectile could be formed through a normal casting or molding process using any of a variety of materials including silicone-rubber or various urethane mixes which would be utilized to protect the projectile from impact damage while simultaneously protecting the human participants from injury. These materials are familiar to one proficient in the art and will not be explained further here.

The non-lethal projectile could also be utilized with a variety of launchers to simulate a wide range of direct fire small arms including: a bolt for a crossbow, an arrow for a bow, a sphere for a paintball gun (paintball marker), a bullet for a firearm, and others. Standard micro-electronic components would be contained within the non-lethal projectile to form a transmitter or, in another form, an non-powered inductively coupled transducer that would then be energized by a magnetic field projected by the interrogator device contained within the target or some portion of the target.

In one embodiment of the invention, the non-lethal projectile would contain means for storing digitally encoded data internally in the form of a logic circuit or miniature integrated circuit that is known to those proficient in the art and will not be explained further here. In one embodiment of the invention, distinct analog signals could be utilized by the non-lethal projectile through variable electronic components known to those in the art, allowing a plurality of non-lethal projectiles to be individually identifiable through subtle signal differences detected by the reader-target upon contact with the reader-target's magnetic field. Projectiles in all embodiments would be reusable and thus cost effective.

The reader-target-apparatus portion of the invention can be formed of virtually any material and can be coated with conductive material such as a thin film-type antenna as is described within U.S. Pat. No. 5,083,135, or could contain a plurality of coil arrays, each arranged to represent a different portion of the target, but is not limited to such devices. In one form of the invention, the target-apparatus can be constructed in a traditional "bulls-eye" pattern with a graduated series of annular rings, each ring differentiated as a separate receiver/antenna combination for scoring projectile accuracy in a conventional manner in conjunction with the above encoded non-lethal projectiles. In another embodiment, the target-apparatus can be constructed to resemble articles of clothing or body-armor. In yet another embodiment of the invention, the target apparatus, despite its shape or appearance may contain a transceiver for initiating an inductive coupling with transponders contained within an above mentioned form of the non-lethal projectile. This technology is known to those proficient in the electronic arts but will be further illustrated in the accompanying drawings and description. A computer could be used in conjunction with reader-targets if desired, to provide score-keeping functions, record training or gaming sessions and provide other logistical functions.

The present embodiments, described in the foregoing, satisfies the need within the art by providing an actual non-lethal small arms projectile analogous to an arrow, bullet or other lethal projectile, which can then be used on human subjects for training, sport, or entertainment and which contains the necessary means to provide individual scoring, record keeping, computerized analysis, and other sophisticated sporting or training features without visual observation of the participants by any supervising agency.

OBJECTS AND ADVANTAGES

Accordingly, several objects and advantages of the invention are listed below:

(a) It is one object of this invention to improve the realism of tactical training through more closely simulating the characteristics of lethal projectiles;

(b) It is another object of this invention to increase the realism and versatility of combat simulation games;

(c) It is another object of this invention to facilitate the production of encoded non-lethal small arms projectiles and reader-targets;

(d) It is another object of this invention to alleviate the lack of marksmanship caused by expanding-diameter radiant technology small arms training weapons for trainees by offering an actual, non-lethal projectile instead of insubstantial radiant beams;

(e) It is another object of this invention to offer the tactile and sensory benefits of using an actual small arms projectile without the injury and bleeding caused by brittle, frangible projectiles;

(f) Another object of this invention is to provide tactical trainers a means for supervising and grading trainees without visual observation in accordance with the data-transmission capabilities of the non-lethal projectile of the invention;

(g) Yet another object of this invention is to allow combat simulation game operators to eliminate cheating at gaming and sporting functions without reducing thrills, through the advanced electronic scoring means contained within each non-lethal projectile of the invention;

(h) It is another object of this invention to allow realistic combat simulation games utilizing non-lethal projectiles to be operated in standard, more desirable facilities without undue clean-up, due to the solid, reusable nature of the non-lethal small arms projectile of the invention;

(i) Yet another object of this invention is to provide practitioners of sports or games utilizing physical, non-lethal projectiles unique personal scoring abilities in accordance with internal electronics contained within the non-lethal projectile and reader-target of the invention;

(j) Another object of the invention would allow participants of currently existing combat simulation games that utilize small arms non-lethal projectiles to accrue personal scores within games, or tournaments by virtue of the data-transmission means contained within each of the non-lethal projectiles of the invention;

(k) It is yet another object of the invention to allow a greater diversity of projectiles to be utilized in conjunction with target shooting, combat simulation games and other applicable events where a non-lethal projectile may be desired such as archery, wherein participants desire to separately identify non-lethal projectiles for scoring, analysis or other reasons;

(l) It is still a further object of the invention to provide an electronic small arms analogy that can individually attack and communicate to discreet targets or discreet portions of targets within close proximity of other potential targets;

(m) Further objects and advantages of the invention will become apparent from a consideration of the drawings and ensuing descriptions.

DESCRIPTION OF DRAWINGS

In the drawings, closely related figures have the same number but different alphabetic suffixes.

LIST OF REFERENCE NUMERALS

Figure 1:
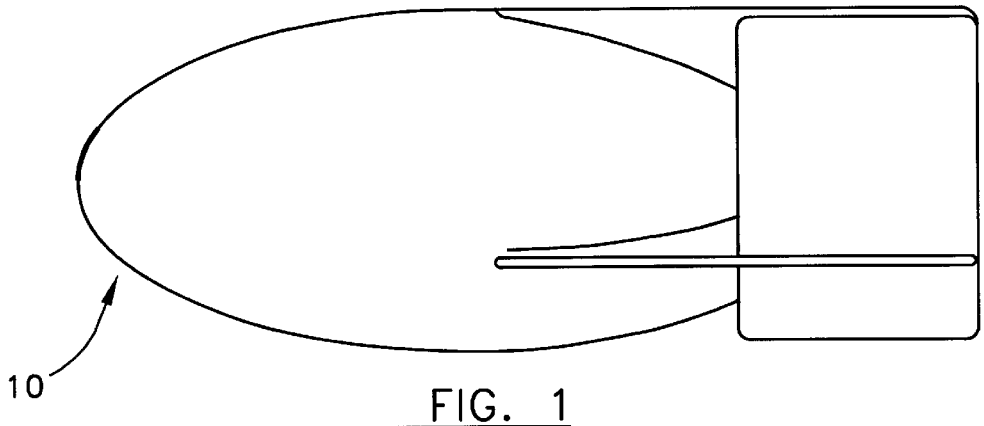
FIG. 1 shows an exterior profile view of a sample non-lethal projectile of the invention encased in energy absorbing material such as silicone-rubber or polyurethane.

10 a non-lethal projectile
12 an impact element
14 an induction element within the non-lethal projectile
16 a logic element within the non-lethal projectile
18 a transmitter element within the non-lethal projectile
20 antennae elements within the non-lethal projectile
22 a reader-target formed as an item of clothing or body armor
24 a status display upon the reader-target
26 an inductive reader element upon the reader-target
28 a conductive material or coating upon the reader-target
32 a receiver antenna within the reader-target
34 a transmitter antenna within the reader target
36 a transceiver element within the inductive reader element
38 a logic element within the inductive reader element
40 an interrogator signal from the inductive reader element
42 an encoded return signal from the non-lethal projectile

DESCRIPTION OF PREFERRED EMBODIMENTS—FIGS. 1 TO 5E

Figure 2:
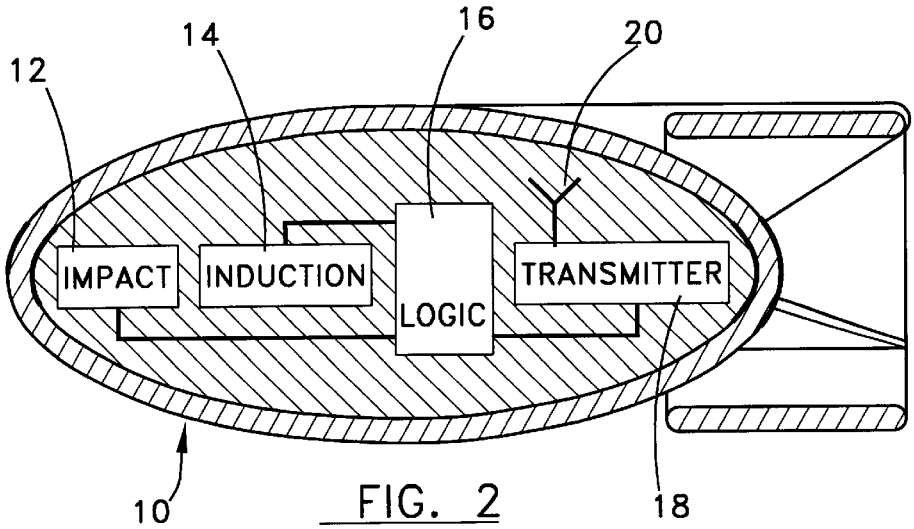
FIG. 2 shows a sample non-lethal projectile of the invention with the electronic components in block diagram form exposed in cross-section.

Now turning to the drawing, and more particularly FIG. 1 thereof, it will be observed that it depicts a detailed drawing of one typical embodiment of a non-lethal projectile 10 formed in a bullet shape and encased with a resilient, energy-absorbing material of a specific gravity slightly less than that of water such as silicone-rubber, though different materials ran be utilized depending on the application. FIG. 2 depicts the non-lethal projectile 10 of this embodiment in cross-section with electronic components explained through use of a block diagram. The block diagram of FIG. 2, beginning at the front or nose portion of the non-lethal projectile 10, is comprised of an optional impact element 12, an induction coil or induction element 14, a logic element 16, a transmitting element 18, and one or more antennae 20. The induction element 14, may be comprised of a coil-wrapped ferrite bar for achieving an inductive coupling with a transmitted signal to generate an electrical charge. The inductive-coupling technology is generic within the electronic arts. The logic element 16 is comprised of a miniature integrated circuit for storage and encoding of data for transmission. The logic element 16 may comprise a register means for receiving a predetermined identification code via the energizing signal. Further, the logic element 16 may include a fixed or alterable identification code within a memory means therein. The transmitting element 18 accepts pulses from the logic element 16 and transmits signals through the antennae element(s) 20.

Figure 3:
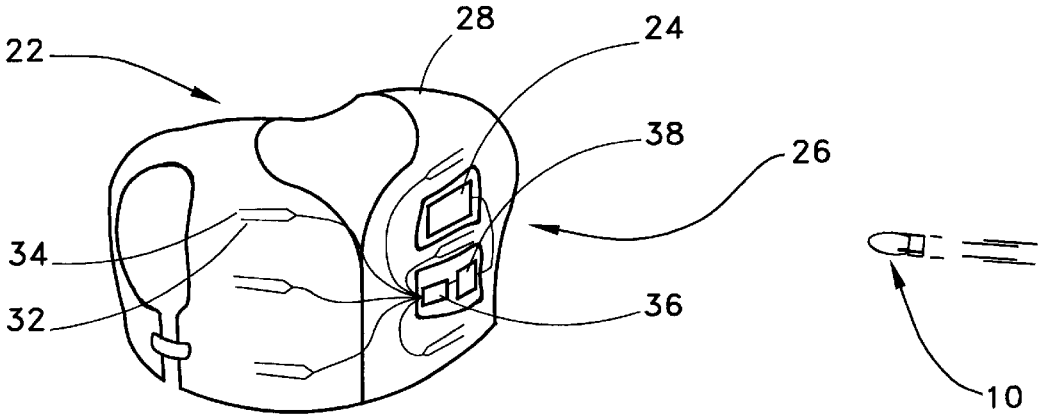
FIG. 3 shows a perspective view of the reader-target formed in the shape of body-armor or clothing with mounted displays pictured thereon and a perspective view of a non-lethal projectile.

A perspective view of the reader-target 22 is pictured in FIG. 3, formed as a piece of clothing or body-armor. At one side of the reader-target 22 a status display 24 and a reader element 26 are shown. The reader-target 22 comprises a conductive surface or coil array 28, a reader element 26 and a status display 24.

Figure 4:
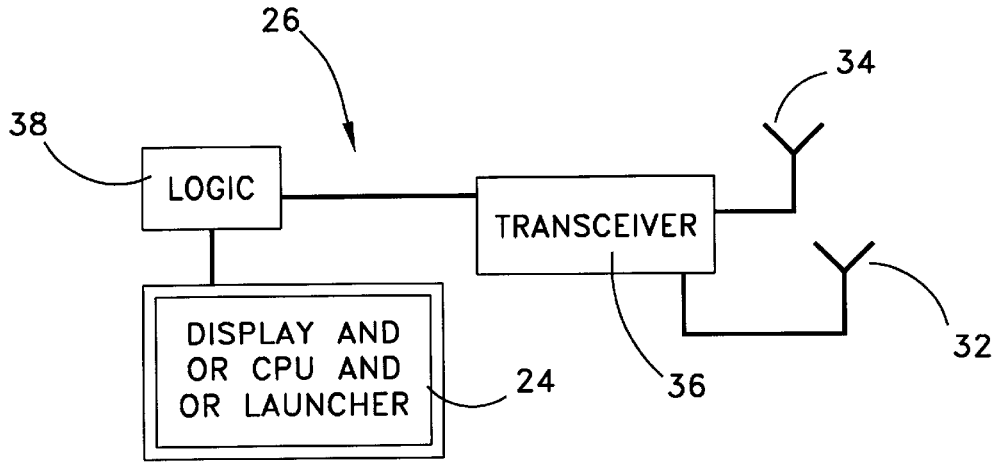
FIG. 4 shows a block diagram of the reader-target electronics.

FIG. 4 is a block diagram of the reader-target 26 electronics. The block diagram of FIG. 4 shows the following elements: a receiver antenna 32, a transmitter antenna 34, a reader transceiver element 36, a reader logic element 38 with decoding, and an output to display 24 and/or other CPU.

FIGS. 5*a* to 5*e* depict the action of a non-lethal projectile 10 approaching the target, being interrogated by the reader element 26 through a magnetic field 40, actuating the internal electronics of the non-lethal projectile 10 to transmit an encoded return signal 42 which is received by the reader element 26, processed, and the appropriate signals then transmitted to the display and/or CPU and/or launcher device.

OPERATION OF INVENTION FIGS. 5A TO 5E

Figure 5A:
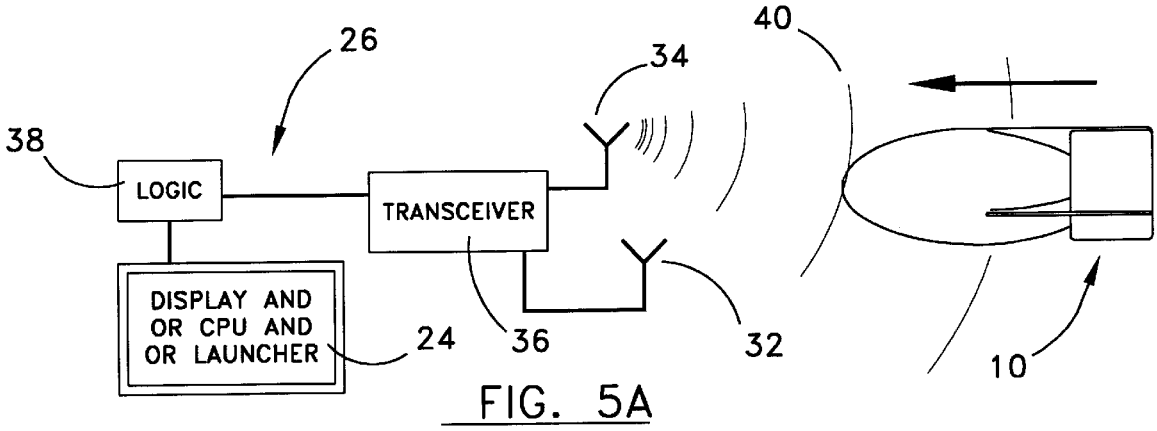
FIGS. 5*a* to 5*e* shows the process of a non-lethal projectile of the invention transiting to the reader-target, being interrogated by the reader-target signal and transmitting the data to the reader-target where it is then decoded and displayed.
Figure 5B:
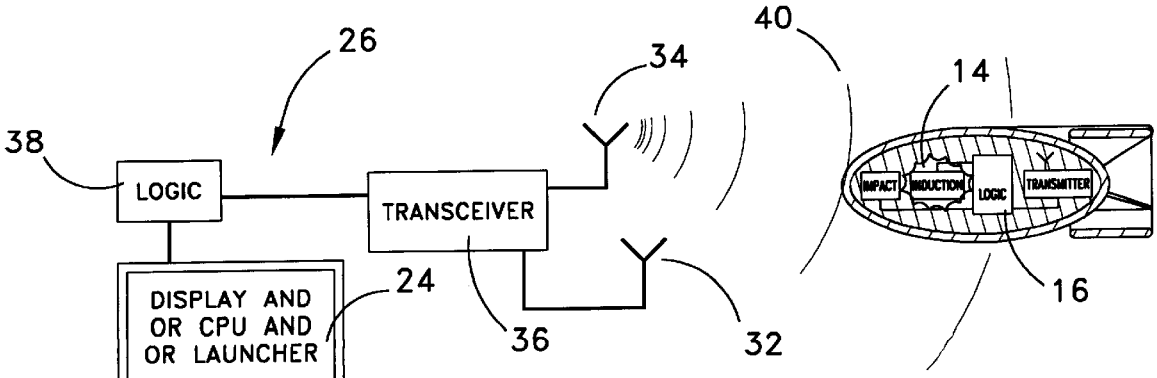
Figure 5C:
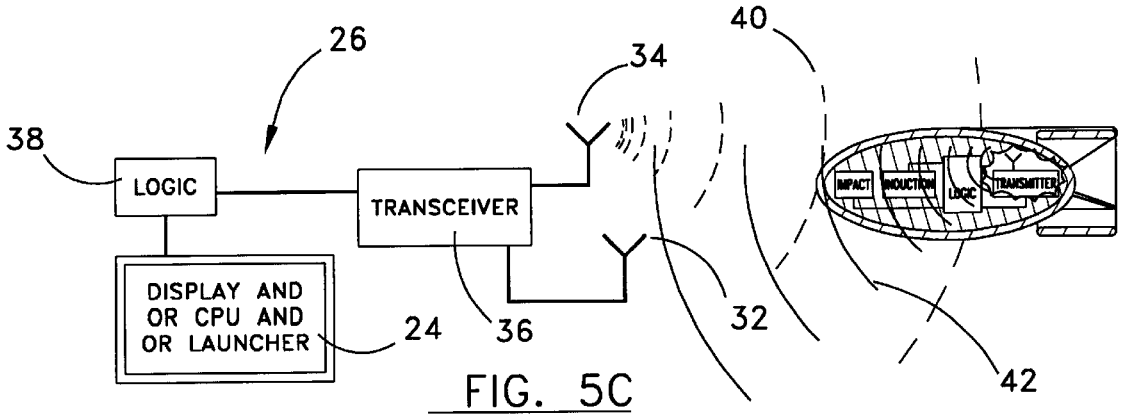
Figure 5D:
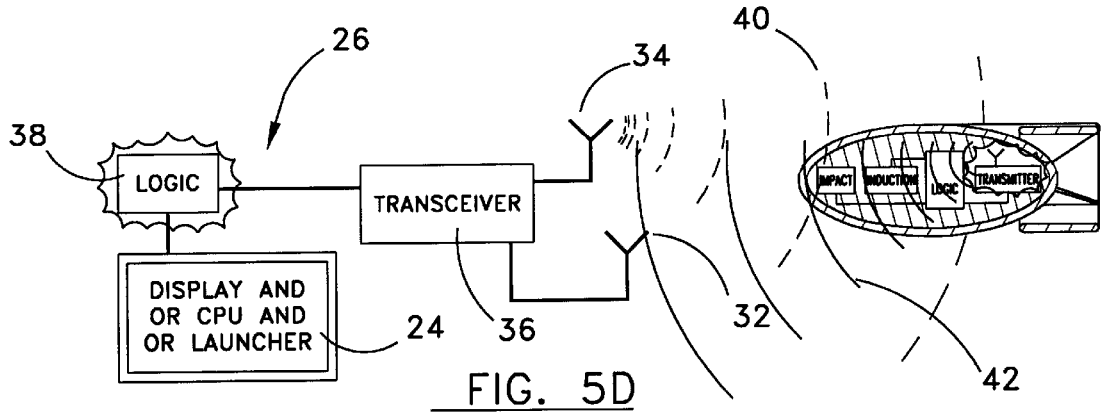
Figure 5E:
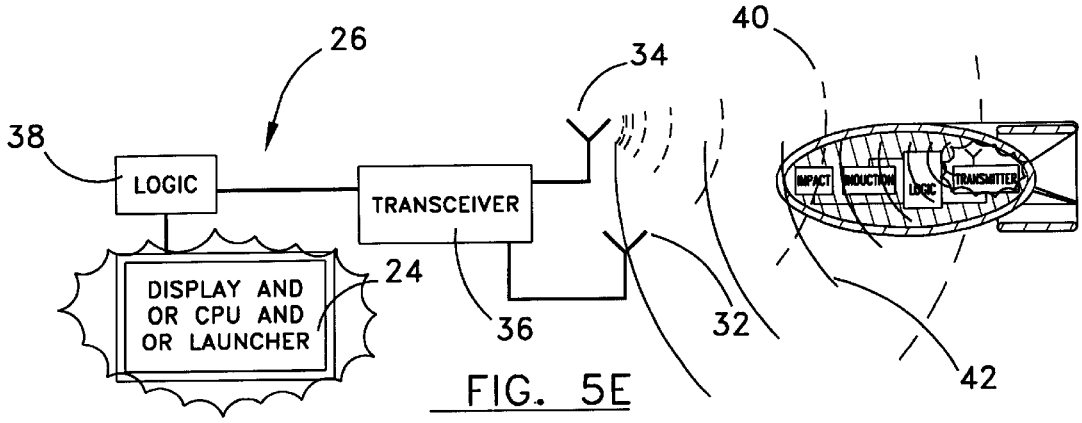

The manner of using the non-lethal projectile and reader-target for purposes of training, sport, or amusement is as follows in this preferred embodiment: Depending on the launching medium, one shoots, or otherwise launches a non-lethal projectile 10 (FIG. 5*a*) toward the inductive-reader element 26 upon the reader-target 22 which would be worn by a human user. As the non-lethal projectile draws within the desired range of the inductive reader element 26, a magnetic field or interrogation signal 40 constantly emanating from the inductive reader element 26 intercepts the non-lethal projectile 10 (FIG. 5*b*), energizing the induction element 14 which sends a pulse of electricity to the logic element 16. The logic element 16 encodes the pulse of electricity into a predetermined serial return code that is then forwarded to the transmitting element 18 (FIG. 5*c*) where it is transmitted as an extreme short-range encoded return signal 42, at a predetermined frequency through the antennae element 20. The encoded return signal 42 is transmitted to the receiving antenna 34 of the transceiver 36 (FIG. 5*d*) where it is conducted through the transceiver 36 to the reader logic element 38. The reader logic element 38 then decodes the encoded return signal 42, and the data is conducted to the display (FIG. 5*e*). The data then indicates a hit and any other required data through the status display 24 (FIG. 3) and may be further conducted to a CPU (computer/computational device) for scoring or other analysis, or used to disarm an opponent's projectile launcher in the case of combat simulation games or tactical training.

In another embodiment of the invention, the impact element 12 could produce an electrical charge upon impact to power the logic element 16 and the transmitter 18. The charge from the impact element 12 could also be used to disarm the non-lethal projectile 10 after transmitting the return signal 42 to avoid scoring additional hits with same non-lethal projectile 10. The impact element 12 could also be utilized to release an electrical charge from an internal battery or capacitor means.

CONCLUSION, RAMIFICATIONS AND SCOPE OF INVENTION

Thus the reader will see that non-lethal projectile and reader-target of this invention provides a new and highly effective alternative for tactical training, combat simulation games, toys, and other applications where non-lethal small arms projectiles containing data will be extremely beneficial. Furthermore, the encoded non-lethal projectile and reader-target has the additional advantages in that

- it provides means for reducing or eliminating cheating from combat simulation games;
- it allows tactical training personnel a realistic medium which closely mimics the performance of normal, lethal small arms projectiles;
- it allows a non-lethal projectile to communicate a variety of data upon coinciding with a target's position;
- it provides a medium which can be utilized to simulate, or as a substitute for, a variety of small arms projectiles including arrows, bullets, pellets, paintballs and others;
- it allows a projectile training, or gaming, medium where injuries will not be incurred from shattered hard-gelatin projectiles;
- it allows combat simulation game providers to sell or rent actual, physical projectiles to players as player consumables;
- it permits individual, personal scores within combat simulation games involving projectiles, by virtue of the electronics contained within each projectile;
- it allows projectiles to be reused many times;
- it permits the production of non-lethal small arms projectiles in variety of shapes for use with a variety of launching methods that may all utilize the same system and operate with the same target-readers;
- it provides an electronic system which can communicate complex data via the non-lethal projectile through modern microchip technology;
- it allows individual non-lethal projectiles to utilize a transmitter or transponder appropriate to the individual application for transmitting data to the reader-target;
- it provides a method for introducing electronics to a non-lethal small arms projectile for scoring or other purposes;
- it provides a system which allows combat simulation game operators to score and supervise participants without visual observation of the participants.
- it provides a small arms projectile analogy capable of attacking discreet targets or portions of targets without effecting other nearby targets.
- it allows for an accurate electronic training projectile that can access a reader-target through intervening material such as paper or clothing.

While the above description contains many specifities, these should not be construed as limiting the scope of the invention but as merely providing illustrations of some of the presently preferred embodiments of this invention. For example, the non-lethal projectile and target apparatus can be used in children's toys to allow personal data to be included and communicated by the projectile in interactive target games; the non-lethal projectile and target apparatus could be used in an archery game wherein each participant's arrows are personally identified so allowing the score to be kept no matter what order the arrows would be launched in, etc.

Thus the scope of the invention should be determined by the appended claims and their legal equivalents, rather than by the examples given.

What is claimed is:

1. A non-lethal small arms analogous projectile for use with a reader-target comprising for purposes of training, sport, or amusement:

(a) a means of broadcasting a transmission from said non-lethal small arms analogous projectile to said reader-target upon coinciding with said reader-target;

(b) a means within said reader-target for receiving said transmission from said non-lethal small arms analogous projectile.

2. The non-lethal small arms analogous projectile and reader-target of claim 1 wherein said non-lethal small arms analogous projectile is encased in a resilient, energy absorbing material to retain shape throughout numerous uses.

3. The non-lethal small arms analogous projectile and reader-target of claim 1 wherein said reader-target is formed of a material that can be molded to fit a variety of shapes including form fitting articles of clothing.

4. The non-lethal small arms analogous projectile and reader-target of claim 1 further including said means within said reader-target for generating an electromagnetic field.

5. The non-lethal small arms analogous projectile and reader-target of claim 1 further including means for converting electromagnetic energy into radio signals within said non-lethal projectile.

6. A small arms analogous, direct-fire, non-lethal projectile for use with a reader-target for purposes of training, sport, or amusement comprising:

(a) a means of storing encoded information within said small arms analogous, direct-fire, non-lethal projectile;

(b) a means of discreetly transmitting said encoded information from said small arms analogous, direct-fire, non-lethal projectile to said reader-target when in close proximity or contact with said reader-target;

(c) a means within said reader-target for receiving said encoded information discreetly transmitted from said small arms analogous, direct-fire, non-lethal projectile;

(d) a means within said reader-target to decode said encoded information;

(e) a padding means about said small arms analogous, direct-fire, non-lethal projectile by which injury to human users will be substantially reduced.

7. The small arms analogous, direct-fire, non-lethal projectile and reader-target of claim 6 wherein said non-lethal projectile utilizes polyurethane construction for said padding means.

8. The small arms analogous, direct-fire, non-lethal projectile and reader-target of claim 6 wherein said reader-target is enclosed in a material that can be tailored to fit a variety of shapes including form fitting articles of clothing.

9. The small arms analogous, direct-fire, non-lethal projectile and reader-target of claim 6 further including an integrated circuit for storing said encoded information within said non-lethal projectile.

10. The small arms analogous, direct-fire, non-lethal projectile and reader-target of claim 6 further including means within said reader-target for generating an electromagnetic field.

11. The small arms analogous, direct-fire, non-lethal projectile and reader-target of claim 6 wherein said non-lethal projectile further includes means for converting electromagnetic energy into a return signal oriented to discreetly address said reader-target to the exclusion of other equidistant reader-targets.

* * * * *

US006604946C1

(12) EX PARTE REEXAMINATION CERTIFICATE (10725th)

United States Patent
Oakes

(10) Number: US 6,604,946 C1
(45) Certificate Issued: Oct. 1, 2015

(54) NON-LETHAL SMALL ARMS PROJECTILE FOR USE WITH A READER-TARGET FOR AMUSEMENT, SPORTS AND TRAINING

(75) Inventor: Mike Glen Oakes, Beaverton, OR (US)

(73) Assignee: TRUE GRIT, LLC, Seattle, WA (US)

Reexamination Request:
No. 90/013,358, Sep. 30, 2014

Reexamination Certificate for:

| | |
|---|---|
| Patent No.: | **6,604,946** |
| Issued: | **Aug. 12, 2003** |
| Appl. No.: | **09/941,954** |
| Filed: | **Aug. 29, 2001** |

(51) Int. Cl.

| | |
|---|---|
| ***F42B 8/00*** | (2006.01) |
| ***F42B 8/12*** | (2006.01) |
| ***F42B 12/36*** | (2006.01) |
| ***F42B 12/02*** | (2006.01) |
| ***F42B 5/02*** | (2006.01) |

(52) U.S. Cl.
CPC . *F42B 5/025* (2013.01); *F42B 8/12* (2013.01); *F42B 12/365* (2013.01)

(58) Field of Classification Search
None
See application file for complete search history.

(56) References Cited

To view the complete listing of prior art documents cited during the proceeding for Reexamination Control Number 90/013,358, please refer to the USPTO's public Patent Application Information Retrieval (PAIR) system under the Display References tab.

*Primary Examiner* — Jeffrey Carlson

(57) ABSTRACT

A non-lethal small acres analogous projectile 10 and reader-target for use in sporting, amusement, or training applications is described, wherein the non-lethal projectile 10 contains encoded information and means for transmitting the encoded information upon coinciding with the reader-target 22. The non-lethal projectile 10 contains a transmitter or transponder 18 which is activated upon coinciding with the reader-target 22, communicating data 42 to a receiver 36 within the reader-target which can then operate hit-indicating means 24, and transfer the data to a computer via contact, or wireless, connection for further analysis and interpretation. The non-lethal projectile 10 can be formed in any of a variety of shapes for use in many diverse applications and can be encased in a resilient, energy-absorbing material to withstand many reuses.

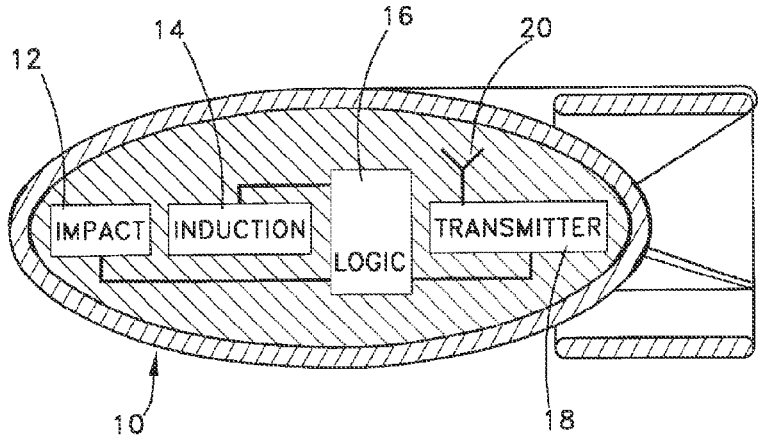

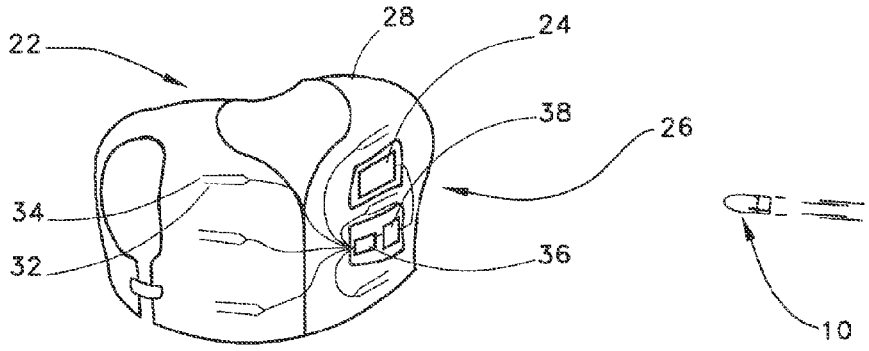

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-5 and 7 are cancelled.

Claims 6 and 8-11 are determined to be patentable as amended.

New claims 12-21 are added and determined to be patentable.

6. A small arms analogous, direct-fire, non-lethal projectile [for use with] *configured to be shot from a crossbow, bow or gun and* a reader-target *for use on a human target* for purposes of *marksmanship* training, sport, or amusement comprising:

*a projectile including:*

[a] (*a*) means [of] *for* storing encoded information within [said] *the* small arms analogous, direct-fire, non-lethal projectile;

[a] (*b*) means [of] *for* discreetly transmitting [said] *the* encoded information from [said small arms analogous, direct-fire, non-lethal] *the* projectile to [said] *the* reader-target *via an RF signal* when *the projectile is* in close proximity *to* or *in* contact with [said] *the* reader-target *on the human target*;

[(c) a means within said reader-target for receiving said encoded information discreetly transmitted from said small arms analogous, direct-fire, non-lethal projectile;

(d) a means within said reader-target to decode said encoded information;]

[(e) a] (*c*) padding means about [said] *the* small arms analogous, direct-fire, non-lethal projectile by which injury to human users will be substantially reduced, *the padding means comprising energy absorbing material to protect the human target from injury upon impact of the projectile with the human target when the projectile is shot from a crossbow, bow, or gun;*

*a reader-target including:*

(*d*) *means within the reader-target for receiving the RF signal with the encoded information;*

(*e*) *means within the reader-target to decode the encoded information and provide indication and scoring of marksmanship hits on the human target;*

*further including a means for record keeping of marksmanship hits on the human target.*

8. The small arms analogous, direct-fire, non-lethal projectile and reader-target of claim 6 wherein said reader-target is enclosed in a material that [can be] *is* tailored to fit a variety of shapes including form fitting articles of clothing.

9. The small arms analogous, direct-fire, non-lethal projectile and reader-target of claim 6 further including an integrated circuit for storing [said] *the* encoded information within [said] *the* non-lethal projectile.

10. The small arms analogous, direct-fire, non-lethal projectile and reader-target of claim 6 further including means within [said] *the* reader-target for generating an electromagnetic field.

11. The small arms analogous, direct-fire, non-lethal projectile and reader-target of claim 6 wherein [said] *the* non-lethal projectile further includes means for converting electromagnetic energy into a return signal oriented to discreetly address [said] *the* reader-target to the exclusion of other equidistant reader-targets.

*12. The small arms analogous, direct-fire, non-lethal projectile and reader-target of claim 6 wherein the padding means comprises*

*a casing sized and shaped to contain the memory device and the RF signal generating device, the casing formed of resilient, energy absorbing material to retain shape throughout shooting and impact, to protect the memory device and the RF signal generating device, and to protect the human target from injury upon impact of the projectile with the human target.*

*13. The small arms analogous, direct-fire, non-lethal projectile and reader-target of claim 6 wherein the projectile has a diameter in the range of 0.2 inches to 1.0 inch.*

*14. The small arms analogous, direct-fire, non-lethal projectile and reader-target of claim 6 wherein the resilient, energy absorbing material has a specific gravity less than the specific gravity of water.*

*15. The small arms analogous, direct-fire, non-lethal projectile and reader-target of claim 6 comprising an impact device capable of producing an electric charge upon impact of the projectile with the human target to power the RF signal generating device.*

*16. The small arms analogous, direct-fire, non-lethal projectile and reader-target of claim 6 wherein the projectile further includes an internal power supply to provide power to the RF signal generating device, and further wherein the RF signal generating device is configured to generate a focused, close-range RF signal to be received only by the receiver associated with the human target impacted by the projectile.*

*17. A system, comprising:*

*a reader target having a transceiver that is capable of receiving RF signals and generating an electromagnetic field, the reader target configured to be associated with a discrete human target and worn as an article of clothing; and*

*a non-lethal, direct fire, small arms analogous projectile to be shot at and directly impact the discrete human target without injuring the human target for discrete adjudication of marksmanship hits on the human target, the projectile including:*

*means for storing encoded data in the projectile;*

*means for transmitting an RF signal coupled to the memory device and capable of transmitting an RF signal that includes encoded data from the means for storing encoded data to the transceiver associated with the human target impacted by the projectile to the exclusion of other equidistant receivers, the RF signal transmitting means configured to generate the RF signal in response to an impact by the projectile with the human target and an inductive coupling of the RF signal generating device with the electromagnetic field generated by the transceiver;*

*padding means sized and shaped to contain the memory device and the RF signal generating device, the padding means formed of a resilient, energy absorbing material to retain shape throughout numerous uses, to protect the means for storing encoded data and the RF signal transmitting means during use, and to protect the human target from injury upon impact of the projectile with the human target;*

*means within the reader-target for receiving the RF signal with the encoded information;*

*means within the reader-target to decode the encoded information and provide indication and scoring of marksmanship hits on the human target;*

*means to provide record keeping of marksmanship hits on the human target.*

*18. The system of claim 17 wherein the projectile has a diameter in the range of 0.2 inches to 1.0 inch.*

*19. The system of claim 17 wherein the resilient, energy absorbing material has a specific gravity less than the specific gravity of water.*

*20. The system of claim 17 further comprising an impact device capable of producing an electric charge upon impact of the projectile with the human target to power the RF signal generating device.*

*21. The system of claim 17 wherein the projectile further includes an internal power supply to provide power to the RF signal transmitting means, and further wherein the RF signal transmitting means is capable of generating a focused, close-range RF signal to be received only by the receiver associated with the human target impacted by the projectile.*

* * * * *